US006958047B2

(12) United States Patent
DeVlieger

(10) Patent No.: US 6,958,047 B2
(45) Date of Patent: Oct. 25, 2005

(54) CHEST VIBRATING DEVICE

(76) Inventor: Marten Jon. DeVlieger, 5209 - 52 Street, Taber, Alberta (CA), T1G 1M4

( * ) Notice: Subject to any disclaimer, the term of this patent is extended or adjusted under 35 U.S.C. 154(b) by 228 days.

(21) Appl. No.: 10/065,307

(22) Filed: Oct. 2, 2002

(65) Prior Publication Data

US 2004/0068212 A1 Apr. 8, 2004

(51) Int. Cl.[7] ..... A61H 23/02
(52) U.S. Cl. ..... 601/71; 601/70; 601/79
(58) Field of Search ..... 601/41, 42, 43, 601/44, 46, 47, 48, 49, 67, 69, 70, 71, 78, 79, 80, 81

(56) References Cited

U.S. PATENT DOCUMENTS

| | | | | | |
|---|---|---|---|---|---|
| 3,053,250 | A | * | 9/1962 | Stubbs | 601/79 |
| 3,291,123 | A | | 12/1966 | Terauchi | |
| 3,310,050 | A | * | 3/1967 | Goldfarb | 601/79 |
| 4,079,733 | A | | 3/1978 | Denton et al. | |
| 4,098,266 | A | | 7/1978 | Muchisky et al. | |
| 4,697,580 | A | | 10/1987 | Terauchi | |
| 4,838,263 | A | | 6/1989 | Warwick et al. | |
| 4,887,594 | A | | 12/1989 | Siegel | |
| 4,977,889 | A | | 12/1990 | Budd | |
| 5,056,505 | A | | 10/1991 | Warwick et al. | |
| 5,167,226 | A | | 12/1992 | Laroche et al. | |
| 5,181,504 | A | | 1/1993 | Ono et al. | |
| 5,235,967 | A | * | 8/1993 | Arbisi et al. | 601/101 |
| 5,261,394 | A | * | 11/1993 | Mulligan et al. | 601/108 |
| 5,334,131 | A | | 8/1994 | Omandam et al. | |
| 5,716,131 | A | * | 2/1998 | Breeding | 366/120 |
| 5,769,797 | A | | 6/1998 | Van Brunt et al. | |
| 6,022,328 | A | * | 2/2000 | Hailey | 601/69 |
| 6,193,678 | B1 | | 2/2001 | Brannon | |
| 6,254,556 | B1 | | 7/2001 | Hansen et al. | |
| 6,547,749 | B2 | | 2/2002 | Hansen | |
| 6,736,785 | B1 | * | 5/2004 | Van Brunt | 601/44 |
| 2002/0111571 | A1 | | 8/2002 | Warwick et al. | |

* cited by examiner

*Primary Examiner*—Justine R. Yu
*Assistant Examiner*—Quang D. Thanh
(74) *Attorney, Agent, or Firm*—Greenlee, Winner and Sullivan, P.C.

(57) ABSTRACT

A chest vibrating device including a frame, shoulder pads, chest pad and back pad. The frame being configured to fit around an upper body of a user. The shoulder pads extending from the frame to rest the frame on shoulders of the user. The chest pad extending from a front inside of the frame towards a chest of the user. The back pad extending from a rear inside of the frame towards a back of the user. The vibrating unit attached to the frame which produces a vibration that travels from the vibrating unit, through the frame onto the chest pad and at least one back pad.

19 Claims, 7 Drawing Sheets

CHEST VIBRATING DEVICE

BACKGROUND OF INVENTION

The present invention generally relates to devices used to for people with Cystic Fibrosis or other lung conditions which obstruct air ways and the lungs. More specifically, the present invention relates to a chest device which produces vibrations in the chest area to loosen obstructions in air ways and the lungs.

Most devices on the market to relieve the congestion of lungs are driven by air pressure for the creation of vibration. These devices are usually big on the user and create mobility problems for the user. Finally, these devices are not directed to the bottom lobes of the lungs, where most infections begin.

It is an object of the present invention to provide device which produces a vibration to loosen obstructions in air ways and the lungs which is self contained and allows mobility of the user.

SUMMARY OF INVENTION

A chest vibrating device including a frame, shoulder pads, chest pad and back pad. The frame being configured to fit around an upper body of a user. The shoulder pads extending from the frame to rest the frame on shoulders of the user. The chest pad extending from a front inside of the frame towards a chest of the user. The back pad extending from a rear inside of the frame towards a back of the user. The vibrating unit attached to the frame which produces a vibration that travels from the vibrating unit, through the frame onto the chest pad and at least one back pad.

DETAILED DESCRIPTION

Figure 1:
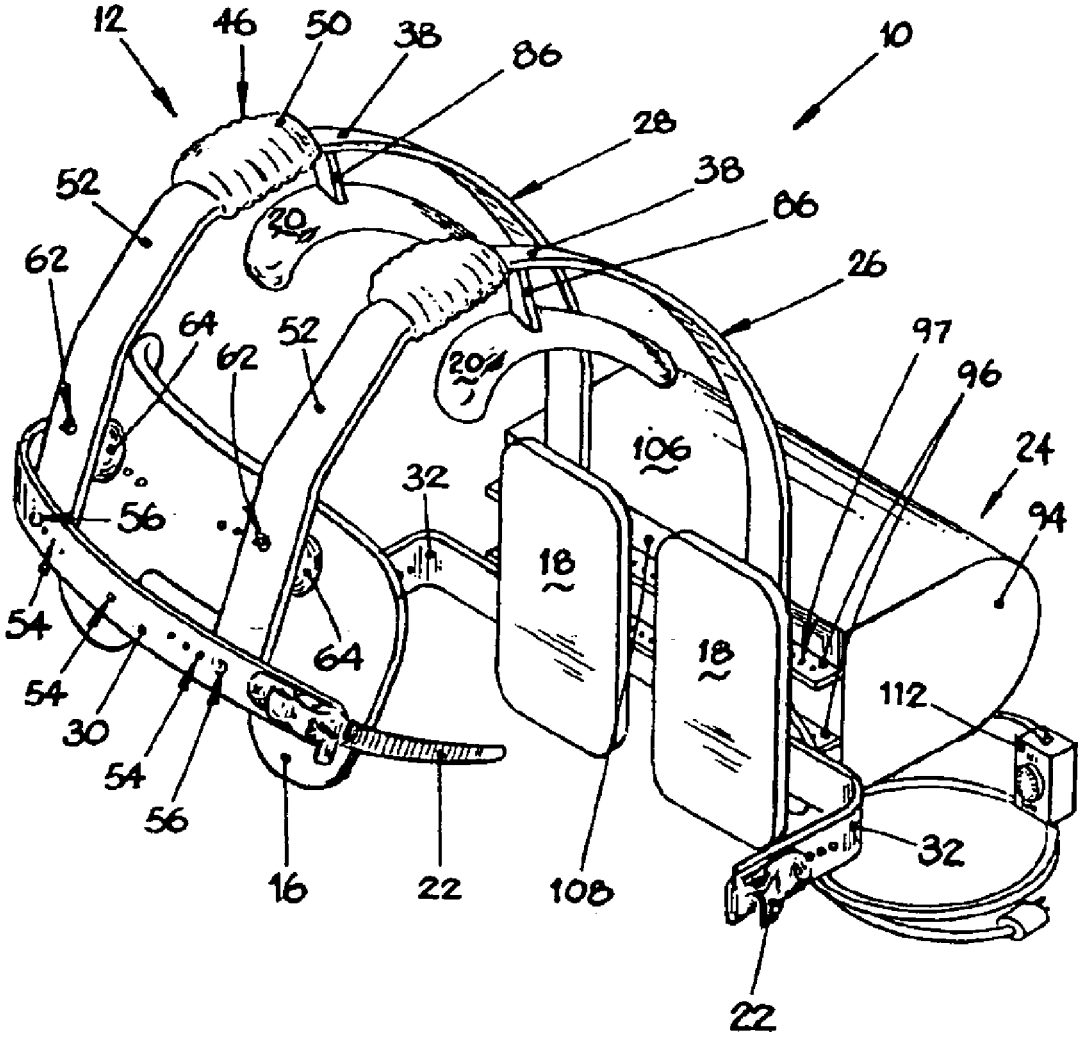
FIG. 1 is a perspective view of a chest vibrating device according to the present invention.

The present invention is a chest vibrating device 10 which is attached to the user, as shown in FIGS. 1–7. The chest vibrating device 10 includes a frame 12, chest pad 16, back pads 18, shoulder pad 20, clamping unit 22 and vibrating unit 24. The chest vibrating device 10 vibrates and transfers vibrations to the lungs of the user. This clears the lungs by loosening obstructions in the air ways. The chest vibrating device 10 is fully adjustable to fit all sizes and can be fitted for both male or female users. The chest vibrating device 10 can be used for people with Cystic Fibrosis or other lung conditions with obstructed air ways.

Figure 2:
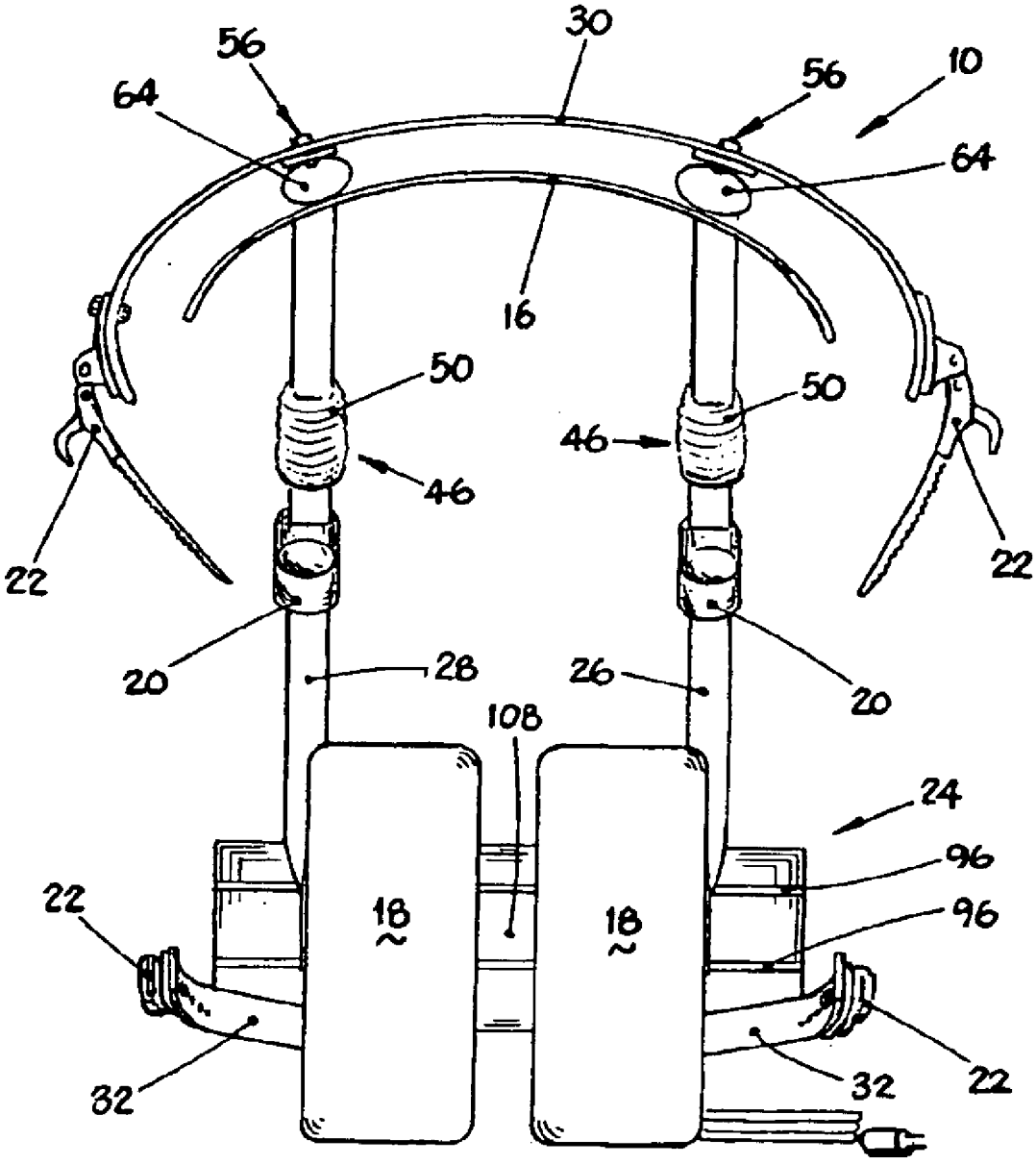
FIG. 2 is a front view of a chest vibrating device according to the present invention.
Figure 3:
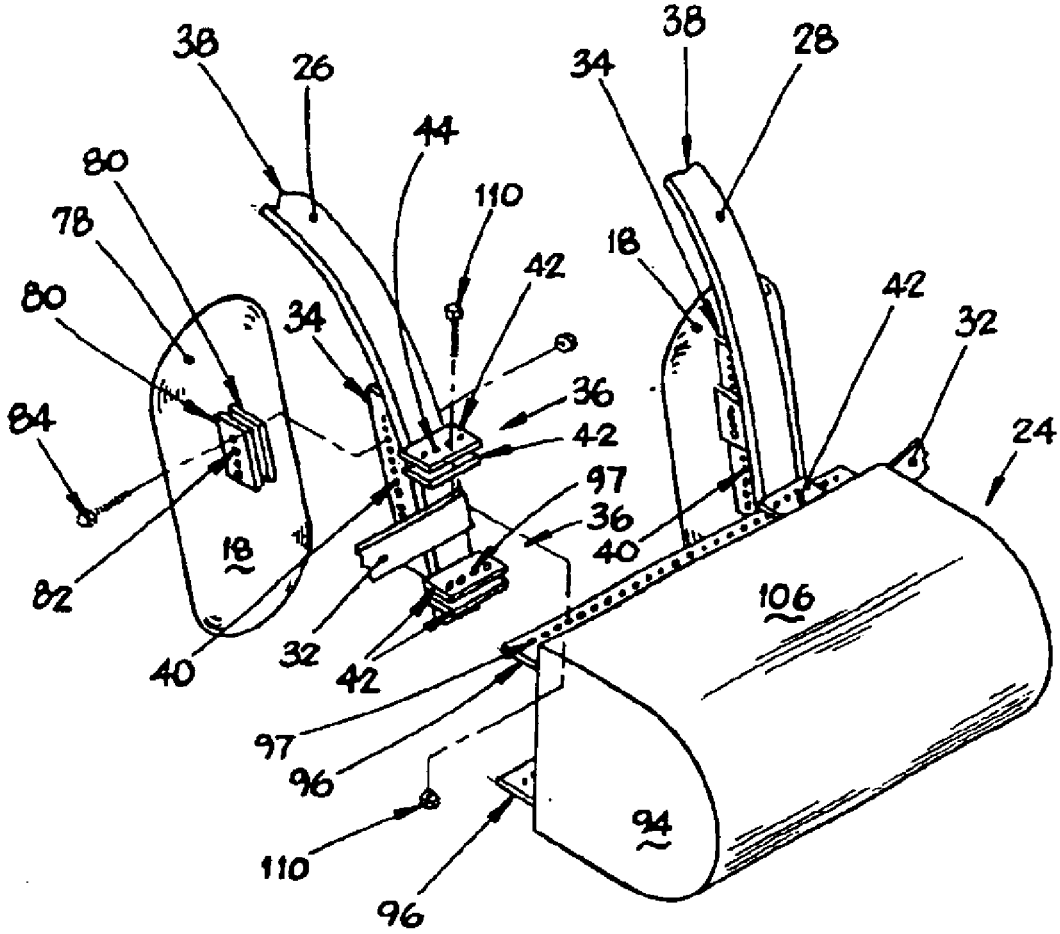
FIG. 3 is a partial rear exploded view of a chest vibrating device according to the present invention.
Figure 4:
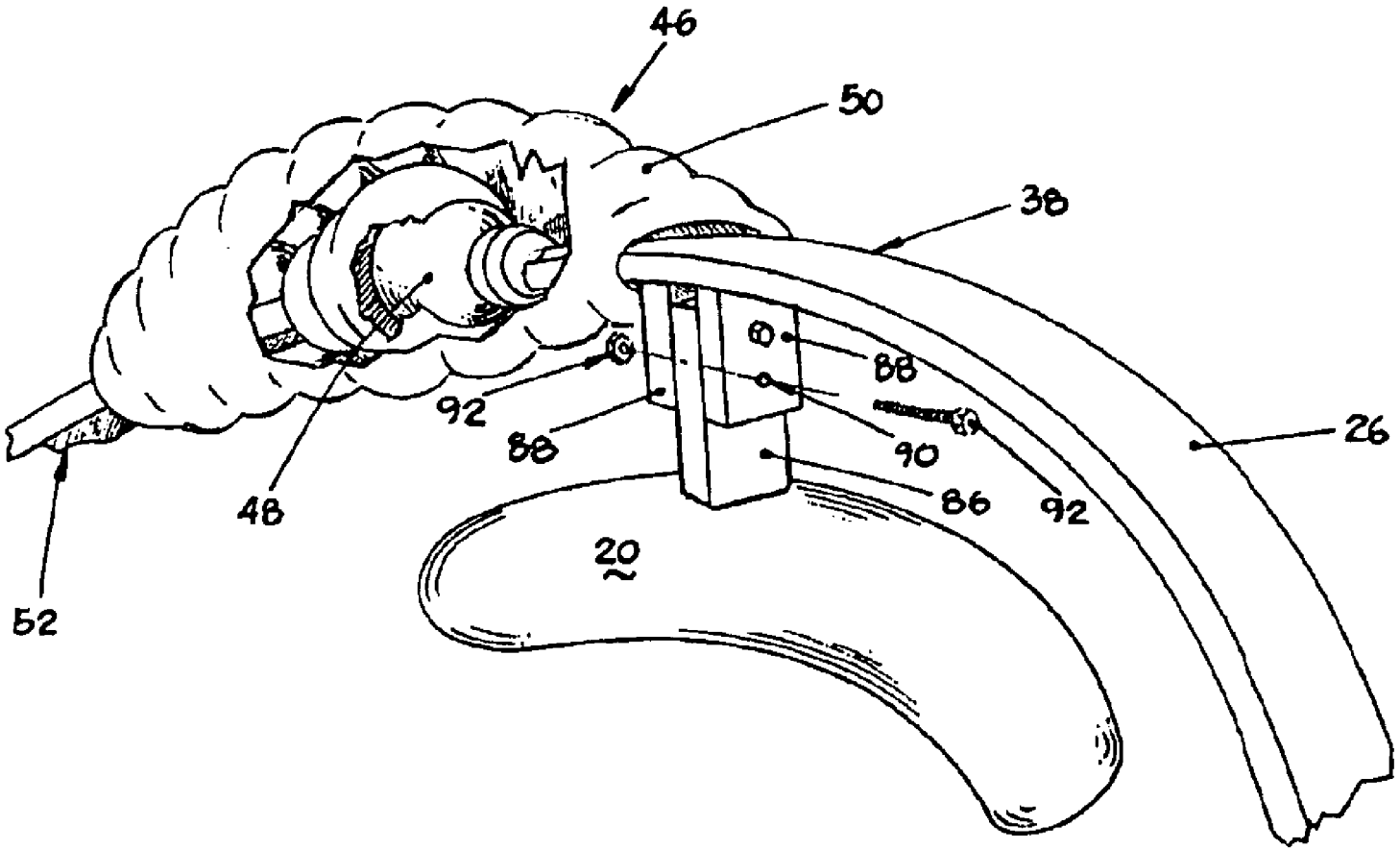
FIG. 4 is a partial cutaway perspective view of a hinge and shoulder pad according to the present invention.
Figure 5:
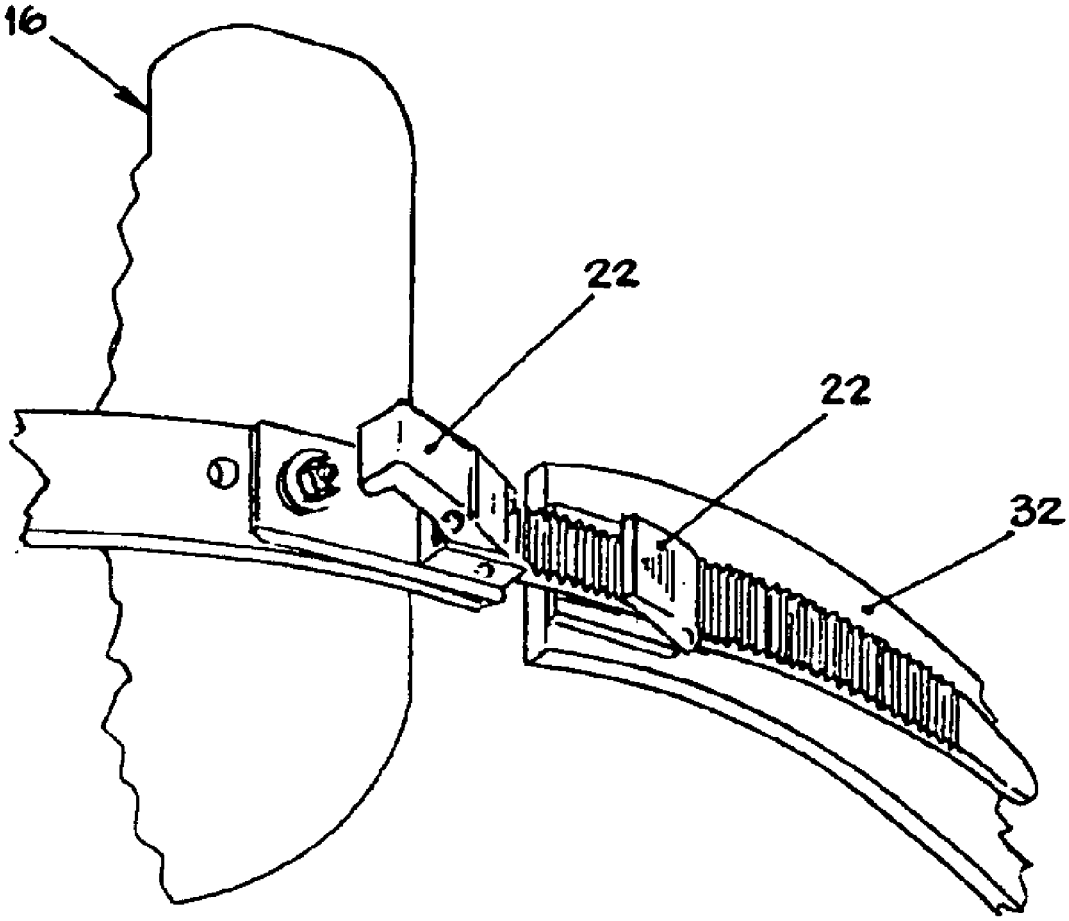
FIG. 5 is a partial perspective view of a clamping unit according to the present invention.

The frame 12 includes a left arm, right arm, cross-member 30 and clamp support 32. The left and right arms 26, 28 each include back pad rails 34 and housing rail receivers 36. As shown in FIG. 3, each back pad rail 34 extends from a inside surface of the left and right arms 26, 28 at the rear half 38 of the frame 12 to connect to the back pads. Each back pad rail 34 includes a plurality of holes 40 along the back pad rail 34. Each housing rail receiver 36 is a pair of rails 42 extending outward from the left and right arms 26, 28 at the rear half 38 of the frame 12 and includes a plurality of aligned holes 44. The left and right arms 26, 28 each include a hinge 46 along their length at about the half way point, as shown in FIGS. 1–2 and 4. The hinges 46 allow the opening and closing of the frame 12 for entrance by the user. FIG. 4 shows the employment of a ball hinge 48 and a flexible hinge cover 50. The hinge cover 50 is used to reduce wear, for looks and for safety of the user. The cross-member 30 is attached to the front half 52 of the left and right arms 26, 28. As shown in FIG. 1, the cross-member 30 includes holes 54 to allow the adjustment of positioning of the left and right arms 26, 28. Fasteners 56 are used to attach the cross-member 30 to the left and right arms 26, 28. The left and right arms 26, 28 also include clamp supports 32 attached to the rear half 38 of the left and right arms 26, 28. The clamp supports 32 extend from the rear and towards the front of the frame 12. A clamping unit 22 is attached to the cross-member 30 and the clamp support 32 on each side of the frame 12. The clamping unit 22 is fully adjustable to various size users. The clamping unit 22 shown in FIGS. 1–2 and 5–6 is similar to belt-buckle combinations used in ski boots and in-line skates.

Figure 6:
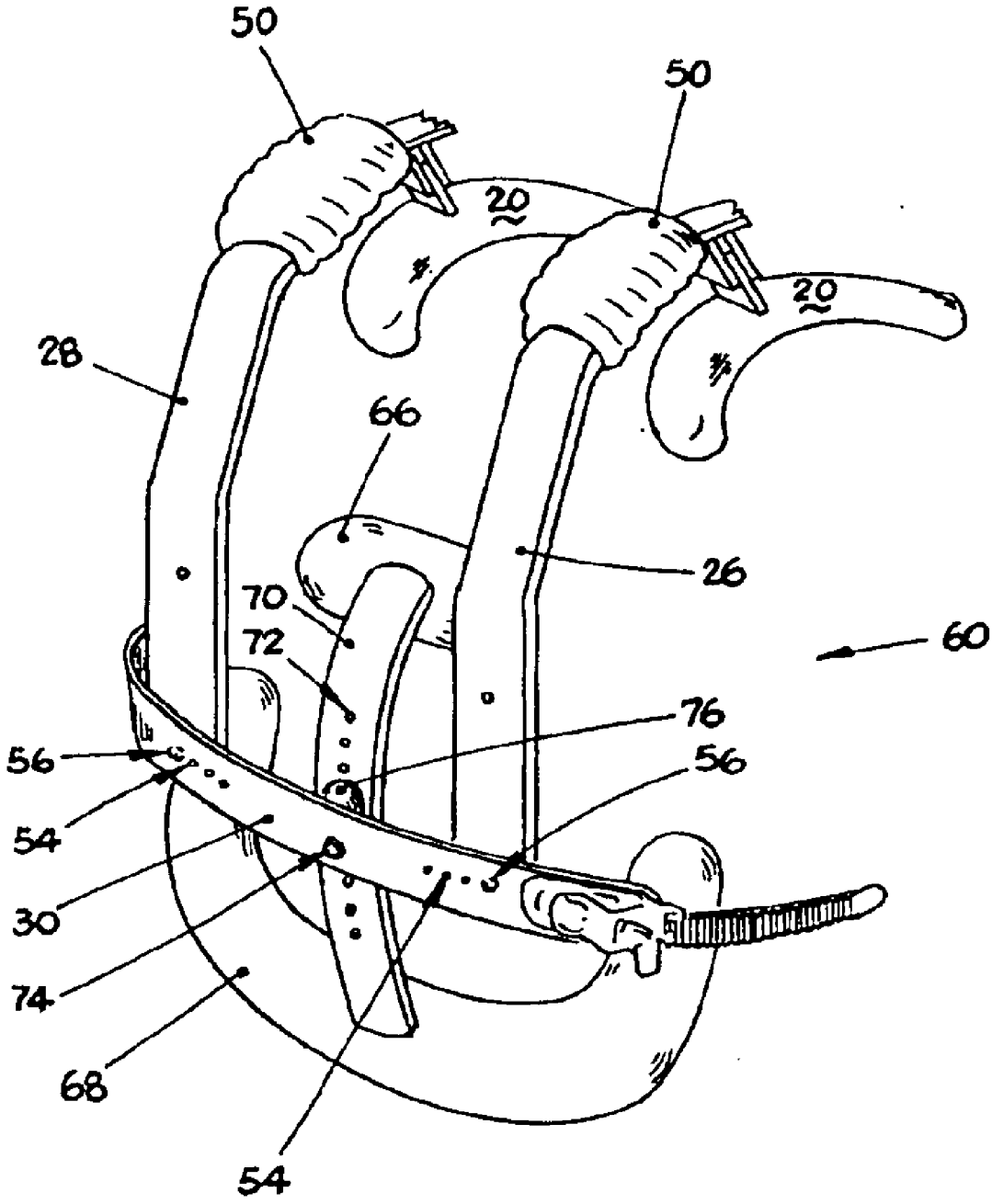
FIG. 6 is a partial perspective view of a female version chest pad according to the present invention.
Figure 7:
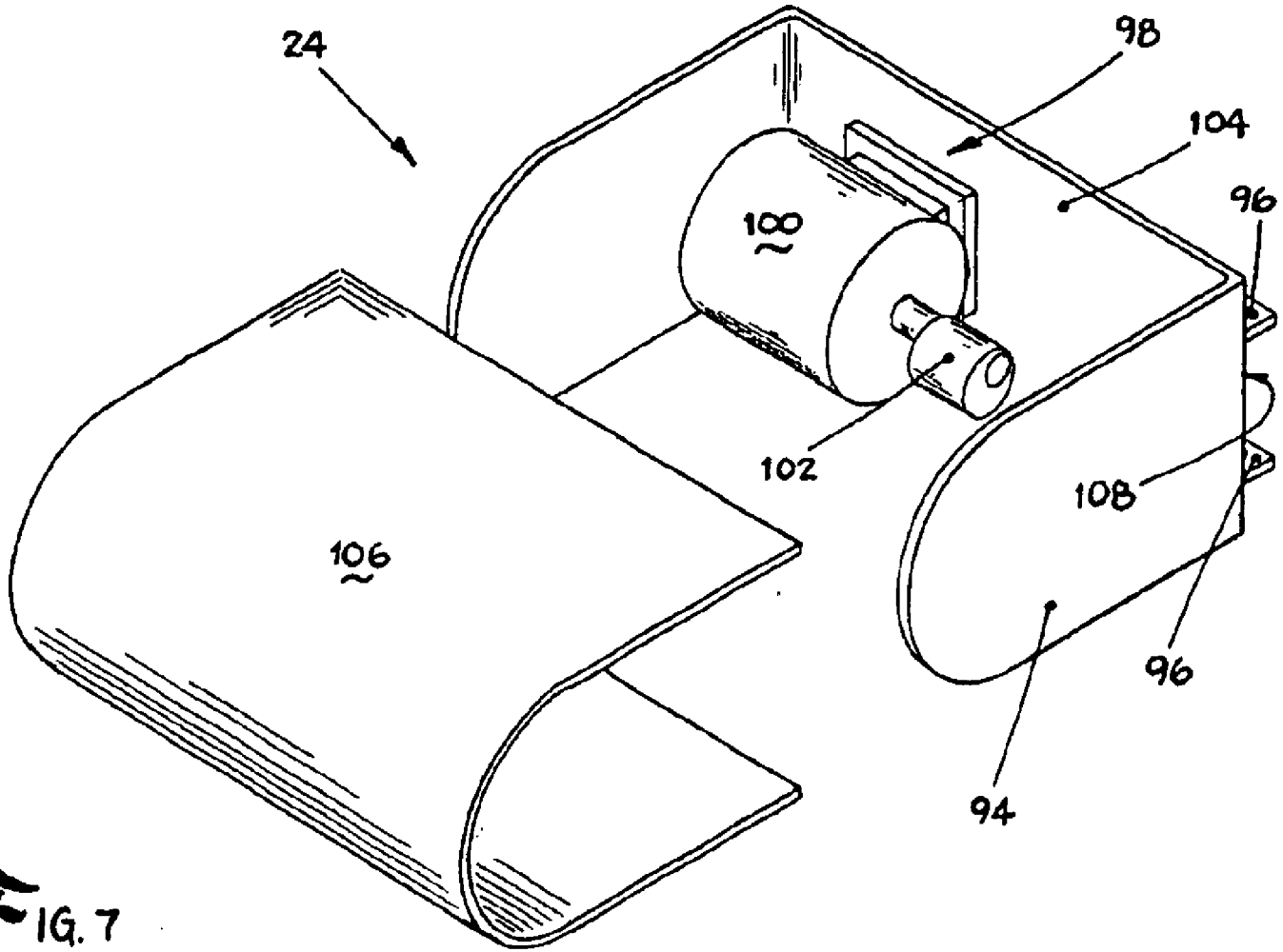
FIG. 7 is an exploded view of a vibrating unit according to the present invention.

FIGS. 1–2 show a male version of the chest pad 16 and FIG. 6 shows a female version of the chest pad 60. The male chest pad 16 is mounted to the inside front half 52 of the left and right arms 26, 28 using fasteners 62 and rubber mounts 64. The male chest pad 16 is sized such that the chest pad 16 extends down to vibrate the lower lobs of the lungs. The female chest pad 60 includes an upper pad 66, lower pad 68 and pad bar 70. The upper pad 66 is connected to the top of the pad bar 70. The lower pad 68 is connected to the bottom of the pad bar 70. The pad bar 70 includes adjustment holes 72 and is connected to the cross-member 30 using fasteners 74 and rubber mount 76. The upper pad 66 is sized to produce vibrations in the top of the lungs. The lower pad 68 is sized to produce vibrations that reach not only the front of the lower lungs, but also the sides of the middle and lower lobs. The pad bar 70 is curved to wrap around the chest of a female.

The back pads 18 are sized to reach from the upper to the lower lobs of the lung. The back pads 18 include back pad rail receivers 78, as shown in FIG. 3. Each back pad rail receiver 78 is a pair of rails 80 extending outward from the rear of the back pads 18 and includes a plurality of aligned holes 82. The back pads 18 are mounted to the left and right arms 26, 28 by sliding the back pad rails 34 between the rails 80 of the back pad rail receiver 78. Then, one of the holes 40 of the back pad rail 34 is aligned with a set of aligned holes 82 of the back pad rail receiver 78 and a fastener 84 is inserted to secure the back pads 18 to the left and right arms 26, 28. The shoulder pads 20 are curve shaped to fit over the shoulders of the user and include shoulder pad supports 86, as shown in FIGS. 1 and 4. The shoulder pad 20 are designed to transfer the weight of the invention to the shoulders of the user. The shoulder pads 20 should be padded for comfort of the user. FIG. 1 shows the shoulder pad supports 86 attached permanently using a technique such as welding, while FIG. 4 shows the shoulder pad supports 86 mounted between two plates 88 extending from the left and right arms 26, 28. The mounting as shown in FIG. 4 includes holes 90 through the two plates 88 and the shoulder pad support 86 and fasteners 92 are used to connect the two plates 88 and the shoulder pad support 86. The chest pad 16, back pads 18 and shoulder pads 20 can include a coating that molds to the shape of the user for comfort.

The vibrating unit 24 is shown in FIGS. 1–3 and 7. The vibrating unit 24 includes a housing 94, housing rails 96 and vibrator 98. The vibrator 98 is show as a motor 100 which rotates an off-set weight 102 to cause vibrations. The motor 100 is usually of the type that runs on twelve Volt DC or one-hundred-and-twenty Volt AC. The motor 100 is mounted to the inside back 104 of the housing 94. The housing 94 includes a housing cover 106 for safety. The housing rails 96 extend outward and along the outside back 108 of the housing 94. The vibrating unit 24 is mounted to the frame 12 by inserting housing rails 96 between the rails 42 of the housing rail receivers 36 of the left and right arms 26, 28, and fastening using fasteners 110 through holes 97. The vibrations generated by the vibrator 98 are transferred through the housing 94 and the housing rails 96 onto the frame 12 and then to the chest and back pads 16, 18.

The operation of the chest vibrating device 10 is as follows. The user adjusts the position of the left and right arms 26, 28 along the housing rails 96 and cross-member 30 for proper sizing. The user lifts the front half 52 of the left and right arms 26, 28 upward along the hinges 46 to enter the frame 12. Then, the user slips into the frame 12 and closes the front half 52 of the left and right arms 26, 28 along the hinges 46. Finally, the user uses the clamping unit 22 to secure the frame 12 about the user, such that the chest pad 16 and back pads 18 are pressured against the user. The chest vibrating device 10 can then be turned on to create vibrations. The vibrations transferred to the chest and back pads 16, 18 are passed onto the lungs through the chest and back of the user. As shown in FIG. 1, the chest vibrating device 10 can include a controller 112 to vary the intensity of the vibrations to create different strengths of vibrations to clear secreted mucus from the lungs.

While different embodiments of the invention have been described in detail herein, it will be appreciated by those skilled in the art that various modifications and alternatives to the embodiments could be developed in light of the overall teachings of the disclosure. Accordingly, the particular arrangements are illustrative only and are not limiting as to the scope of the invention that is to be given the full breadth of any and all equivalents thereof.

What is claimed is:

1. A chest vibrating device comprising:

a frame to fit around an upper body of a user, the frame comprising:

a left arm, said left arm being in a shape of a curve to fit around the upper body of the user, said left arm having a front half of said curve and a rear half of said curve;

a right arm, said right arm being in a shape of a curve to fit around the upper body of the user, said right arm having a front half of said curve and a rear half of said curve;

a cross-member connecting said left and right arms together at said front halves;

shoulder pads extending from said frame to rest said frame on shoulders of the user;

a chest pad extending from a front inside of said frame towards a chest of the user, said chest pad attached to said front halves of said left and right arms to transfer the vibration;

at least one back pad extending from a rear inside of said frame towards a back of the user, said at least one back pad attached to said rear halves of said left and right arms to transfer the vibration; and a vibrating unit attached to said rear halves of said left and right arms which produces a vibration that travels from said vibrating unit, through said frame onto said chest pad and at least one back pad.

2. The chest vibrating device of claim 1, wherein a hinge connects said front and rear halves of each of said left and right arms.

3. The chest vibrating device of claim 2, further comprising:

at least one clamping unit to clamp said front and rear halves of each of said left and right arms together about the user.

4. The chest vibrating device of claim 2, further comprising:

at least one clamping unit on each side of said frame to clamp said front and rear halves of each of said left and right arms together about the user.

5. The chest vibrating device of claim 2, wherein a shoulder pad support extends toward the user from said left arm;

wherein a shoulder pad support extends toward the user from said right arm; and wherein said shoulder pads are are attached to said shoulder pad supports.

6. The chest vibrating device of claim 1, wherein positioning of said left and right arms is adjustable along said cross-member and said vibrating unit.

7. The chest vibrating device of claim 6, wherein said vibrating unit further comprises housing rails;

wherein said left and right arms further comprise housing rail receivers, each of which are a pair of rails in which said housing rails fit between; and wherein said vibrating unit is attached by inserting said housing rails between said pair of rails of said housing rail receivers and fastening together using fasteners.

8. The chest vibrating device of claim 1, wherein said vibrating unit is a housing and a vibrator mounted inside said housing.

9. The chest vibrating device of claim 8, wherein said vibrator is a motor and an offset weight connected to and rotated by said motor.

10. The chest vibrating device of claim 1, wherein said chest pad is one piece and configured to fit a male user.

11. The chest vibrating device of claim 1, wherein said chest pad further comprises an upper pad and a lower pad, said upper and lower pads connected to a pad bar, said pad bar connected to said frame, and said upper pad, lower pad and pad bar configured to fit a female user.

12. The chest vibrating device of claim 1, wherein there are two back pads; and wherein said back pads are attached to an inside of said rear halves of said left and right arms.

13. The chest vibrating device of claim 12, wherein said back pads are adjustable along said inside of said rear halves of said left and right arms.

14. The chest vibrating device of claim 1, wherein a hinge connects said front and rear halves of each of said left and right arms; and wherein positioning of said left and right arms is adjustable along said cross-member and said vibrating unit.

15. The chest vibrating device of claim 14, wherein said vibrating unit is a housing and a vibrator mounted inside said housing.

16. The chest vibrating device of claim 15, wherein said vibrator is a motor and an offset weight connected to and rotated by said motor.

17. The chest vibrating device of claim 15, wherein said vibrator is a motor and an offset weight connected to and rotated by said motor; wherein there are two back pads; wherein said back pads are attached to an inside of said rear halves of said left and right arms; and further comprises at least one clamping unit to clamp said front and rear halves of each of said left and right arms together about the user.

18. The chest vibrating device of claim 14, further comprising:

two back pads, and wherein said back pads are attached to an inside of said rear halves of said left and right arms.

19. The chest vibrating device of claim 14, further comprising:

at least one clamping unit to clamp said front and rear halves of each of said left and right arms together about the user.

* * * * *

UNITED STATES PATENT AND TRADEMARK OFFICE

CERTIFICATE OF CORRECTION

PATENT NO. : 6,958,047 B2
APPLICATION NO. : 10/065307
DATED : October 25, 2005
INVENTOR(S) : Marten Jan DeVlieger It is certified that error appears in the above-identified patent and that said Letters Patent is hereby corrected as shown below:

The claims are hereby corrected to read as follows:

Col. 3, Line 47 should read

1. A chest vibrating device for use in loosening obstructions in the lungs or air way of a user, comprising:

a frame to fit around an upper body of the user, the frame comprising:

a left arm, said left arm being in a shape of a curve to fit around the upper body of the user, said left arm having a front half of said curve and a rear half of said curve;

a right arm, said right arm being in a shape of a curve to fit around the upper body of the user, said right arm having a front half of said curve and a rear half of said curve;

a cross-member connecting said left and right arms together at said front halves;

shoulder pads extending from said frame to rest said frame on the shoulders of the user;

one or more chest pads extending from a front inside of said frame towards a chest of the user, said one or more chest pads being attached to said front halves of said left and right arms to transfer the vibrations;

at least one back pad extending from a rear inside of said frame towards a back of the user for positioning over an area of the lungs of the user, said at least one back pad being attached to said rear halves of said left and right arms to transfer the vibrations; and a vibrating unit attached to said left and right arms to produce vibrations that travels from said vibrating unit, through said frame onto said one or more chest pads and said at least one back pad.

Col. 4, Line 7 should read

2. The chest vibrating device of claim 1, wherein the one or more chest pads and the at least one back pad are sized to be positioned over an area of the lungs of the user.

Col. 4, Line 10 should read

3. The chest vibrating device of claim 2, wherein the one or more chest pads are sized to be positioned over the lower lobes of the user's lungs.

Col. 4, Line 15 should read

4. The chest vibrating device of claim 2, wherein the one or more chest pads are sized to be positioned over the upper and lower lobes of the user's lungs.

UNITED STATES PATENT AND TRADEMARK OFFICE

CERTIFICATE OF CORRECTION

PATENT NO. : 6,958,047 B2
APPLICATION NO. : 10/065307
DATED : October 25, 2005
INVENTOR(S) : Marten Jan DeVlieger It is certified that error appears in the above-identified patent and that said Letters Patent is hereby corrected as shown below:

Col. 4, Line 21 should read
5. The chest vibrating device of claim 4, wherein the one or more chest pads are also sized to be positioned over the front and sides of the middle and lower lobes of the lungs.

Col. 4, Line 28 should read
6. The chest vibrating device of claim 5, wherein the at least one back pad is sized to be positioned over the upper and lower lobes of the lungs.

Col. 4, Line 31 should read
7. The chest vibrating device of claim 6, wherein the vibrating unit is attached to said rear halves of said left and right arms.

Col. 4, Line 39 should read
8. The chest vibrating device of claim 7, wherein a hinge connects said front and rear halves of each of said left and right arms.

Col. 4, Line 42 should read
9. The chest vibrating device of claim 7, wherein positioning of said left and right arms is adjustable along said cross-member and said vibrating unit.

Col. 4, Line 45 should read
10. The chest vibrating device of claim 9, wherein said vibrating unit further comprises housing rails;

wherein said left and right arms further comprise housing rail receivers, each of which are a pair of rails in which said housing rails fit between; and wherein said vibrating unit is attached by inserting said housing rails between said pair of rails of said housing rail receivers and fastening together using fasteners.

Col. 4, Line 47 should read
11. The chest vibrating device of claim 7, wherein said vibrating unit comprises a housing and a vibrator mounted inside said housing.

Col. 4, Line 52 should read
12. The chest vibrating device of claim 11, wherein said vibrator comprises a motor and an offset weight connected to and rotated by said motor.

Col. 4, Line 57 should read
13. The chest vibrating device of claim 7, wherein said one or more chest pads is one piece and configured to fit a male user.

UNITED STATES PATENT AND TRADEMARK OFFICE

CERTIFICATE OF CORRECTION

PATENT NO. : 6,958,047 B2
APPLICATION NO. : 10/065307
DATED : October 25, 2005
INVENTOR(S) : Marten Jan DeVlieger It is certified that error appears in the above-identified patent and that said Letters Patent is hereby corrected as shown below:

Col. 4, Line 59 should read
14. The chest vibrating device of claim 7, wherein said one or more chest pads comprises an upper pad and a lower pad, said upper and lower pads being connected to a pad bar, said pad bar being connected to said frame, and said upper pad, lower pad and pad bar being configured to fit a female user.

Col. 4, Line 65 should read
15. The chest vibrating device of claim 7, wherein the at least one back pad comprises two back pads; and wherein said back pads are attached to an inside of said rear halves of said left and right arms.

Col. 5, Line 1 should read
16. The chest vibrating device of claim 15, wherein said back pads are adjustable along said inside of said rear halves of said left and right arms.

Col. 5, Line 4 should read
17. The chest vibrating device of claim 8, further comprising:

at least one clamping unit to clamp said front and rear halves of each of said left and right arms together about the user.

Col. 6, Line 1 should read
18. The chest vibrating device of claim 7, wherein a hinge connects said front and rear halves of each of said left and right arms; and wherein positioning of said left and right arms is adjustable along said cross-member and said vibrating unit.

Col. 6, Line 6 should read
19. The chest vibrating device of claim 18, wherein said vibrating unit comprises a housing and a vibrator mounted inside said housing.

Col. 6, Line 11 should read following claim 19
20. The chest vibrating device of claim 19, wherein said vibrator comprises a motor and an offset weight connected to and rotated by said motor.

21. The chest vibrating device of claim 18, wherein the at least one back pad comprises two back pads, wherein said back pads are attached to an inside of said rear halves of said left and right arms.

UNITED STATES PATENT AND TRADEMARK OFFICE

CERTIFICATE OF CORRECTION

PATENT NO. : 6,958,047 B2
APPLICATION NO. : 10/065307
DATED : October 25, 2005
INVENTOR(S) : Marten Jan DeVlieger It is certified that error appears in the above-identified patent and that said Letters Patent is hereby corrected as shown below:

22. The chest vibrating device of claim 18, further comprising:
at least one clamping unit to clamp said front and rear halves of each of said left and right arms together about the user.

Col. 6, Line 11 should read following claim 19

23. The chest vibrating device of claim 19, wherein said vibrator comprises a motor and an offset weight connected to and rotated by said motor; wherein the at least one back pad comprises two back pads; wherein said back pads are attached to an inside of said rear halves of said left and right arms; and further comprising:
at least one clamping unit to clamp said front and rear halves of each of said left and right arms together about the user.

24. The chest vibrating device of claim 8, further comprising;
at least one clamping unit on each side of said frame to clamp said front and rear halves of each of said left and right arms together about the user.

25. The chest vibrating device of claim 8, further comprising:
a shoulder pad support extending toward the user from said left arm;
a shoulder pad support extending toward the user from said right arm; and
wherein said shoulder pads are attached to said shoulder pad supports.

UNITED STATES PATENT AND TRADEMARK OFFICE

CERTIFICATE OF CORRECTION

PATENT NO. : 6,958,047 B2
APPLICATION NO. : 10/065307
DATED : October 25, 2005
INVENTOR(S) : Marten Jan DeVlieger It is certified that error appears in the above-identified patent and that said Letters Patent is hereby corrected as shown below:

26. A method of loosening obstructions in the lungs or air way of a user, comprising:

providing the chest vibrating device of claim 1;

positioning the device over the upper body of the user so as to position the one or more chest pads and the at least one back pad over an area or the user's lungs;

producing vibrations with the device and transferring the vibrations to the lungs of the user to loosen obstructions in the lungs or air way of the user.

Signed and Sealed this

Twenty-eighth Day of August, 2007

JON W. DUDAS
*Director of the United States Patent and Trademark Office*